US010955772B1

(12) United States Patent
Meguro

(10) Patent No.: US 10,955,772 B1
(45) Date of Patent: Mar. 23, 2021

(54) BELT POSITIONING STRUCTURE, BELT AND ROLLER UNIT, AND IMAGE FORMING APPARATUS

(71) Applicant: TOSHIBA TEC KABUSHIKI KAISHA, Tokyo (JP)

(72) Inventor: Takehiro Meguro, Hiratsuka Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/824,734

(22) Filed: Mar. 20, 2020

(51) Int. Cl.
*G03G 15/16* (2006.01)

(52) U.S. Cl.
CPC ..... *G03G 15/1615* (2013.01); *G03G 15/1625* (2013.01)

(58) Field of Classification Search
CPC ..... G03G 15/1615; G03G 15/1625
See application file for complete search history.

(56) References Cited

U.S. PATENT DOCUMENTS 6,871,038 B2 * 3/2005 Fujiwara ..... G03G 15/161 198/840
2006/0291913 A1 * 12/2006 Hiroe ..... G03G 15/161 399/312
2015/0277332 A1 * 10/2015 Taira ..... G03G 15/6529 399/381
2016/0313677 A1 10/2016 Oyama

FOREIGN PATENT DOCUMENTS

JP 2019-053257 A * 4/2019 ..... G03G 15/16

* cited by examiner

*Primary Examiner* — G. M. A Hyder
(74) *Attorney, Agent, or Firm* — Amin, Turocy & Watson, LLP

(57) ABSTRACT

According to one embodiment, there is provided a belt positioning structure including a belt roller, a belt, a projection, and a first rotating body. The belt roller is rotatable about a roller axis. The belt is wound around the belt roller. The projection is provided so as to protrude from an inner peripheral surface of the belt. The first rotating body regulates the projection from moving in a first direction approaching the belt roller along the roller axis. The first rotating body is rotatable around an axis. At least a portion of an outer peripheral surface of the first rotating body faces a side surface of the projection on the first direction side.

12 Claims, 7 Drawing Sheets

BELT POSITIONING STRUCTURE, BELT AND ROLLER UNIT, AND IMAGE FORMING APPARATUS

FIELD

Embodiments described herein relate generally to a belt positioning structure, a belt and roller unit, and an image forming apparatus.

BACKGROUND

As an image forming apparatus, there are a multi-function peripheral (MFP) which is a multifunction machine, a printer, a copying machine, and the like. The image forming apparatus transfers a toner image to an endless transfer belt and transfers the toner image to a recording medium such as a paper sheet.

The transfer belt may include a rib on an inner peripheral surface thereof for preventing the belt from being deviated. A roller around which the transfer belt is wound may include a regulating plate on which the rib can abut. The regulating plate forms an inclined surface on which the rib can abut. The regulating plate returns the rib and the transfer belt to a normal position by the inclined surface. For that reason, skewing of the transfer belt can be suppressed.

When the transfer belt is skewed greatly, a deviating force of the belt may exceed a regulation force for returning the rib to the normal position by the inclined surface of the regulating plate. In this case, the rib rides up on the inclined surface of the regulating plate. When the rib rides over the inclined surface up to a cylindrical belt winding surface, the rib and the transfer belt may come off from their normal positions and fall off.

DETAILED DESCRIPTION

Figure 1:
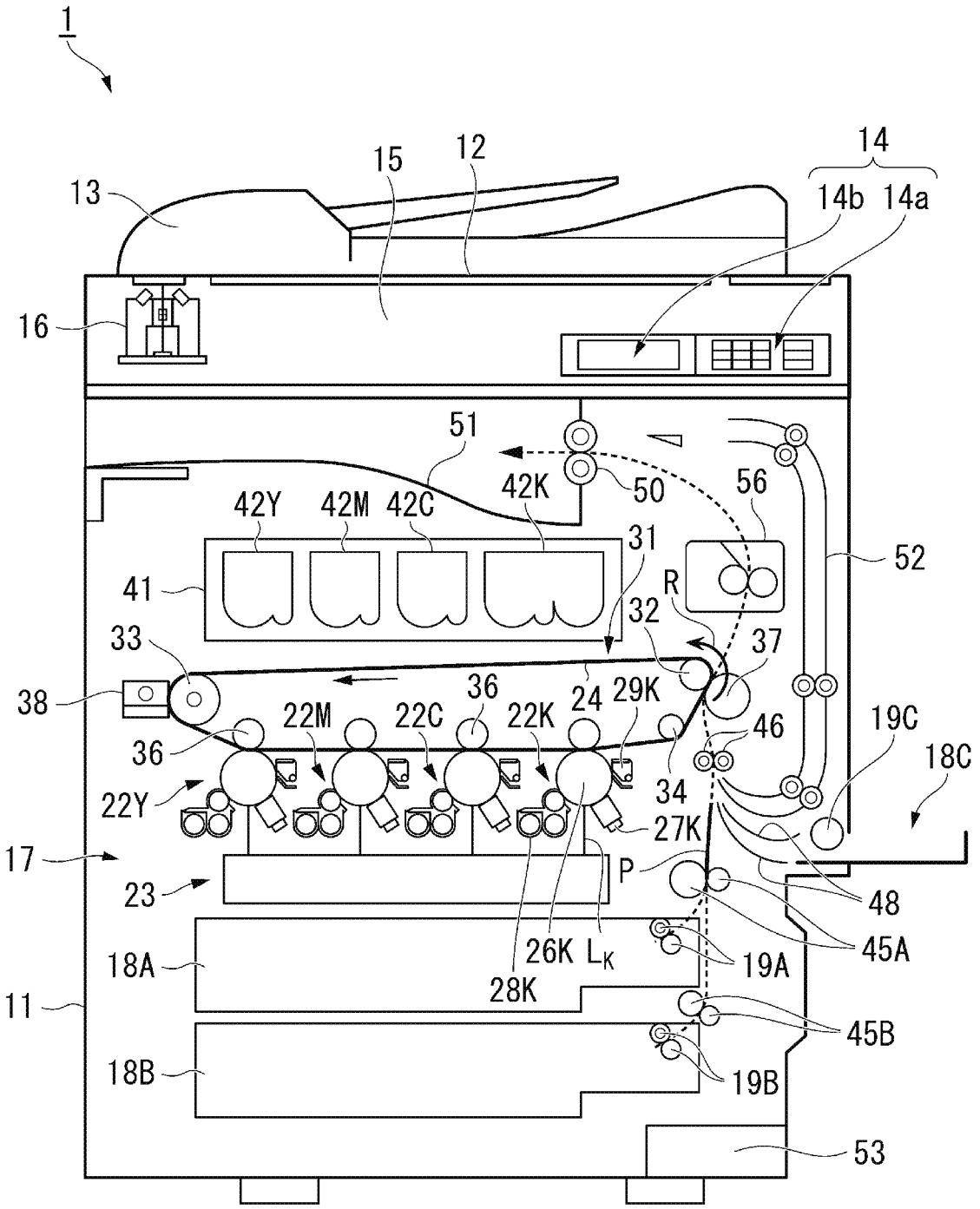
FIG. 1 is a schematic view of an example of an overall configuration of an image forming apparatus according to an embodiment.

In general, according to one embodiment, there is provided a belt positioning structure including a belt roller, a belt, a projection, and a first rotating body. The belt roller is rotatable about a roller axis. The belt is wound around the belt roller. The projection is provided so as to protrude from an inner peripheral surface of the belt. The first rotating body regulates the projection from moving in a first direction approaching the belt roller along the roller axis. The first rotating body is rotatable around an axis. At least a portion of an outer peripheral surface of the first rotating body faces a side surface of the projection on the first direction side.

Hereinafter, a belt positioning structure, a belt and roller unit, and an image forming apparatus according to an embodiment will be described with reference to the accompanying drawings. In the respective drawings, the same components are denoted by the same reference numerals. In each drawing, the size and shape of each member may be exaggerated or simplified for easy viewing.

As illustrated in FIG. 1, an image forming apparatus 1 is, for example, a multi-function peripheral (MFP) which is a multifunction machine, a printer, a copying machine, and the like. Hereinafter, a case where the image forming apparatus 1 is the MFP will be described as an example.

A configuration of the image forming apparatus 1 is not particularly limited. For example, the image forming apparatus 1 includes a main body 11. On the upper part of the main body 11, a document table 12 including transparent glass is provided. An automatic document feeder (ADF) 13 is provided on the document table 12. On the upper part of the main body 11, an operation unit 14 is provided. The operation unit 14 includes an operation panel 14*a* including various keys and a touch panel type operation and display unit 14*b*.

A scanner unit 15 is provided below the ADF 13. The scanner unit 15 reads a document sent by the ADF 13 or a document placed on the document table 12. The scanner unit 15 generates image data of the document. For example, the scanner unit 15 includes an image sensor 16. For example, the image sensor 16 may be a contact type image sensor. The image sensor 16 moves along the document table 12 when reading an image of the document placed on the document table 12.

A sheet feed cassette 18A (18B) includes a sheet feed mechanism 19A (19B). The expression "The sheet feed cassette 18A (18B) includes the sheet feed mechanism 19A (19B)" means that both the sheet feed cassette 18A includes the sheet feed mechanism 19A, and the sheet feed cassette 18B includes the sheet feed mechanism 19B. The same applies to the following description.

The sheet feed mechanism 19A (19B) picks up sheets (sheet-shaped recording media such as paper sheets) P one by one from the sheet feed cassette 18A (18B) and sends the sheets to a conveyance path of the sheet P. For example, the sheet feed mechanism 19A (19B) may include a pickup roller, a separation roller, and a sheet feed roller.

A manual sheet feed unit 18C includes a manual sheet feed mechanism 19C. The manual sheet feed mechanism 19C picks up the sheets P one by one from the manual sheet feed unit 18C and sends the sheets P to the conveyance path.

A printer unit (image forming unit) 17 forms an image on the sheet P based on image data read by the scanner unit 15 or image data generated by a personal computer or the like. The printer unit 17 is, for example, a tandem-type color printer.

The printer unit 17 includes image forming parts 22Y, 22M, 22C, and 22K for colors of yellow (Y), magenta (M), cyan (C), and black (K) corresponding to color separation components of a color image, an exposure device 23, and an intermediate transfer belt 24.

A configuration of the printer unit 17 is not limited to this, and the printer unit 17 may include two or three image forming parts, or the printer unit 17 may include five or more image forming parts.

Although not illustrated, the exposure device 23 includes a light source, a polygon mirror, an f-0 lens, a reflection mirror, and the like. The exposure device 23 irradiates a surface of a photoreceptor drum of each of the image forming parts 22Y, 22M, 22C, and 22K with exposure light, based on the image data.

The configurations of the image forming parts 22Y, 22M, 22C, and 22K are the same as each other except that a color of a toner is different. As the toner, any of a normal color toner and a decolorable toner may be used. Here, the decolorable toner is a toner that becomes transparent when heated at a predetermined temperature or higher. The image forming apparatus 1 may be the image forming apparatus 1 that can use the decolorable toner, or may be the image forming apparatus 1 that cannot use the decolorable toner.

The intermediate transfer belt 24 is an endless belt. The intermediate transfer belt 24 is wound around a secondary transfer backup roller 32, a cleaning backup roller 33, and a tension roller. In the embodiment, when the secondary transfer backup roller 32 is driven to rotate, the intermediate transfer belt 24 runs around (rotates). An arrow R in the figure indicates a driving direction (rotation direction) of the secondary transfer backup roller 32.

Around the intermediate transfer belt 24, the image forming parts 22Y, 22M, 22C, and 22K, a secondary transfer roller 37, and a belt cleaning mechanism 38 are disposed. A plurality of primary transfer rollers 36 are disposed on the inner peripheral side of the intermediate transfer belt 24 so as to face the image forming parts 22Y, 22M, 22C, and 22K.

The printer unit 17 of the embodiment includes a belt and roller unit 31 that is detachable (replaceable) from the main body of the printer unit 17. The belt and roller unit 31 is configured to include the intermediate transfer belt 24, the secondary transfer backup roller 32, the cleaning backup roller 33, the tension roller 34, and the plurality of primary transfer rollers 36.

Hereinafter, a configuration common to the image forming parts 22Y, 22M, 22C, and 22K will be described using the image forming part 22K as an example.

The image forming part 22K includes a photoreceptor 26K, a charger 27K, a developing device 28K, and a cleaner 29K.

The photoreceptor 26K is formed in a drum shape. An electrostatic latent image such as a character or an image is formed on the surface of the photoreceptor 26K by exposure light LK. The charger 27K charges the surface of the photoreceptor 26K. The developing device 28K supplies a toner to the surface of the photoreceptor 26K to develop the electrostatic latent image. The cleaner 29K cleans the surface of the photoreceptor 26K.

The primary transfer roller 36 of the image forming part 22K forms a primary transfer nip by sandwiching the intermediate transfer belt 24 between the primary transfer roller 36 and the photoreceptor 26K. A power source (not illustrated) is connected to the primary transfer roller 36. At least one of a predetermined direct current (DC) voltage and a predetermined alternating current (AC) voltage is applied to the primary transfer roller 36.

The secondary transfer roller 37 forms a secondary transfer nip by sandwiching the intermediate transfer belt 24 between the secondary transfer roller 37 and the secondary transfer backup roller 32. A power source (not illustrated) is connected to the secondary transfer roller 37, similarly to the primary transfer roller 36. At least one of a predetermined DC voltage and a predetermined AC voltage is applied to the secondary transfer roller 37.

The transfer in the image forming apparatus 1 includes a first transfer step and a second transfer step. In the first transfer step, the toner images formed on the photoreceptors 26K of the image forming parts 22Y, 22M, 22C, and 22K are transferred to the intermediate transfer belt 24. In the second transfer step, the toner images transferred to the intermediate transfer belt 24 are transferred (printed) to the sheet P which is a recording medium.

The belt cleaning mechanism 38 includes a cleaning brush and a cleaning blade (reference numerals thereof are omitted) disposed so as to abut on the intermediate transfer belt 24. A waste toner transport hose (not illustrated) extends from the belt cleaning mechanism 38 and is connected to a waste toner container (not illustrated).

A supply unit 41 is disposed above the image forming parts 22Y, 22M, 22C, and 22K. The supply unit 41 supplies the toner to each of the image forming parts 22Y, 22M, 22C, and 22K. The supply unit 41 includes toner cartridges 42Y, 42M, 42C, and 42K. The toner cartridges 42Y, 42M, 42C, and 42K contain yellow, magenta, cyan, and black toners, respectively.

Each of the toner cartridges 42Y, 42M, 42C, and 42K is provided with a marking portion (not illustrated) that allows a main control unit 53, which will be described later, to detect a type of toner contained in each of the toner cartridges. The marking portion includes at least information on colors of the toners of the toner cartridges 42Y, 42M, 42C, and 42K and information for identifying whether the toner is the normal toner or the decolorable toner.

A replenishment path (not illustrated) is provided between each of the toner cartridges 42Y, 42M, 42C, and 42K and the corresponding developing device. The toner is supplied from each of the toner cartridges 42Y, 42M, 42C, and 42K to the corresponding developing device via the replenishment path.

Sheet feed rollers 45A and registration rollers 46 are provided on a conveyance path from the sheet feed cassette 18A to the secondary transfer roller 37. The sheet feed rollers 45A convey the sheet P picked up from the sheet feed cassette 18A by the sheet feed mechanism 19A. The registration rollers 46 adjust a position of a leading end of the sheet P fed from the sheet feed rollers 45A at an abutment position on each other.

The registration rollers 46 convey the sheet P to the secondary transfer nip.

Sheet feed rollers 45B are provided on a conveyance path from the sheet feed cassette 18B to the sheet feed rollers 45A. The sheet feed rollers 45B convey the sheet P picked up from the sheet feed cassette 18B by the sheet feed mechanism 19B toward the sheet feed rollers 45A.

A conveyance path is formed by a conveyance guide 48 between a manual sheet feed mechanism 19C and the registration rollers 46. The manual sheet feed mechanism 19C conveys the sheet P picked up from a manual sheet feed unit 18C toward the conveyance guide 48. The sheet P moving along the conveyance guide 48 reaches the registration rollers 46.

A fixing unit (fixing device) 56 is disposed on a downstream side (upper side in the figure) of the secondary transfer roller 37 in the conveyance direction of the sheet P.

Conveyance rollers 50 are disposed on a downstream side (upper left side in the figure) of the fixing unit 56 in the conveyance direction of the sheet P. The conveyance rollers 50 discharge the sheet P to a sheet discharge unit 51.

A reverse conveyance path 52 is disposed on an upstream side (right side in the figure) of the fixing unit 56 in the conveyance direction of the sheet P. In the reverse conveyance path 52, the sheet P is reversed and guided toward the secondary transfer roller 37. The reverse conveyance path 52 is used when performing double-sided printing.

The image forming apparatus 1 includes a main control unit 53 that controls the entire image forming apparatus 1. The main control unit 53 includes a central processing unit (CPU), a memory, and the like.

The fixing unit 56 includes a fixing belt (belt), a pressurizing roller (roller), and a heater (heating unit) (all are not illustrated). The fixing belt and the pressurizing roller are disposed side by side. The pressurizing roller is pressurized toward the fixing belt side by a pressurizing unit (not illustrated). A nip in which the sheet P is pinched is formed in a portion against where the pressurizing roller and the fixing belt are pressed.

The pressurizing roller is driven to rotate by a drive source such as a motor (not illustrated). When the pressurizing roller is driven to rotate, the driving force of the pressurizing roller is transmitted to the fixing belt through the nip, and the fixing belt is driven to rotate. The sheet P pinched in the nip is conveyed downstream side in the conveyance direction by the rotation of the pressurizing roller and the fixing belt. The fixing belt is heated by the heater, and the toner image transferred to the sheet P is fixed to the sheet P by the heat and pressure of the pressurizing roller. The sheet P after image formation is discharged to the sheet discharge unit 51.

During execution of a printing operation, the intermediate transfer belt 24 may be skewed to run obliquely with respect to a normal rotation direction, or may be deviated to one side in the axis direction of the roller. Such an event may cause excessive input or deformation of the intermediate transfer belt 24, which may lead to breakage or dropout of the intermediate transfer belt 24. For that reason, the image forming apparatus 1 includes a belt positioning structure 30 for preventing the intermediate transfer belt 24 from being deviated.

A belt positioning structure 30A, which is a first example of the belt positioning structure 30, will be described with reference to FIGS. 2 to 4.

Figure 3:
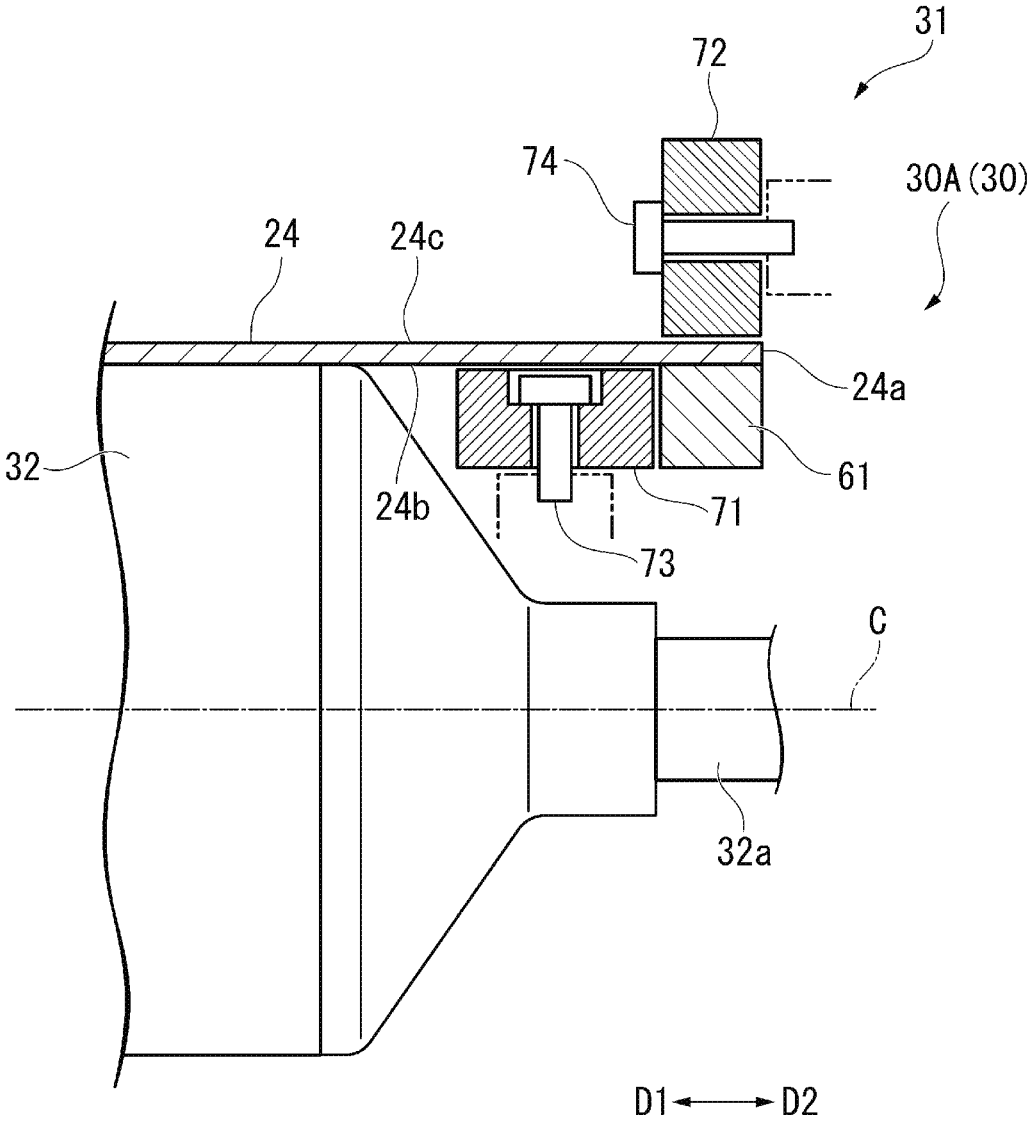
FIG. 3 is a front view of a first example of a belt positioning structure.
Figure 4:
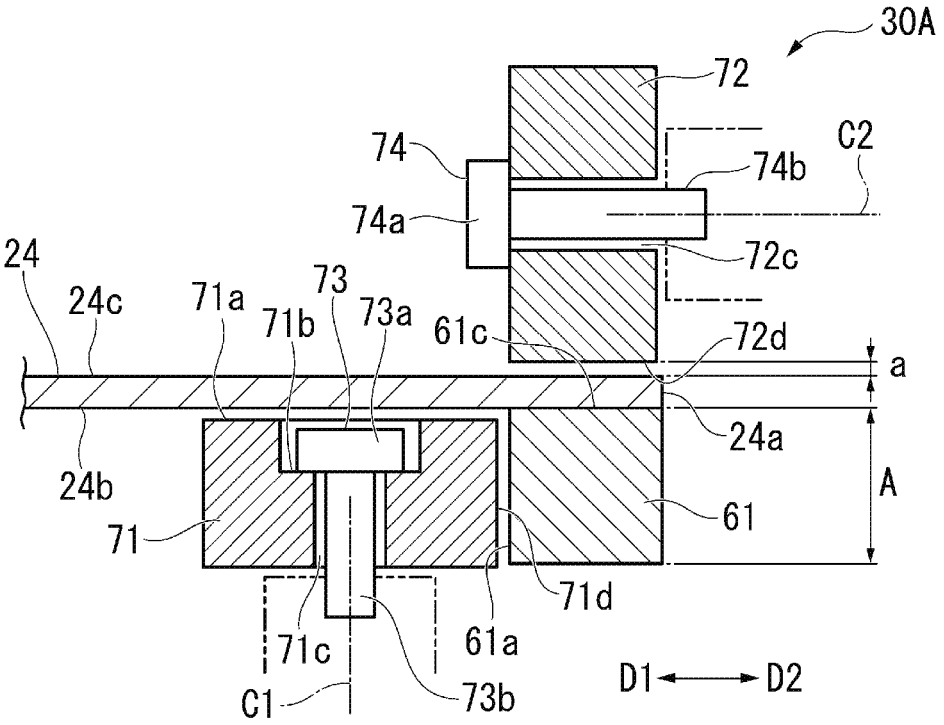
FIG. 4 is a cross-sectional view of the first example of the belt positioning structure.

As illustrated in FIGS. 3 and 4, the belt positioning structure 30A includes the secondary transfer backup roller 32 (belt roller), the intermediate transfer belt 24 (belt), a positioning projection 61 (projection), a first rotating body 71, and a second rotating body 72. In the figures, a reference numeral 32*a* indicates a support shaft of the secondary transfer backup roller 32. A reference symbol C indicates the center axis (roller axis) of the secondary transfer backup roller 32. The secondary transfer backup roller 32 rotates about a center axis C.

Figure 2:
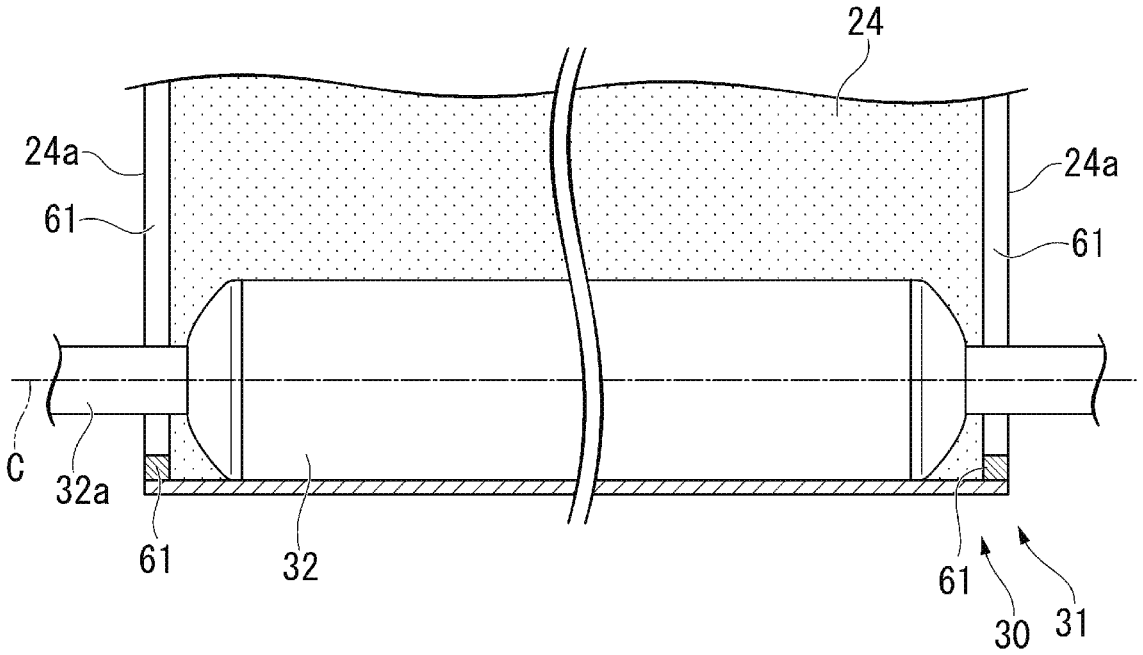
FIG. 2 is a plan view of a secondary transfer backup roller, an intermediate transfer belt, and a positioning projection in the embodiment.

As illustrated in FIGS. 2 to 4, the positioning projection 61 is provided to protrude inward from an inner peripheral surface 24*b* of the intermediate transfer belt 24. A projecting direction of the positioning projection 61 is a thickness direction (downward in FIGS. 3 and 4) of the intermediate transfer belt 24. The positioning projection 61 is a rib (protrusion) extending along a longitudinal direction of the intermediate transfer belt 24. For example, a cross section orthogonal to a length direction of the positioning projection 61 is rectangular. The positioning projection 61 is formed continuously in a length direction of the intermediate transfer belt 24. The positioning projection 61 is preferably formed in an annular shape over the entire length of the intermediate transfer belt 24.

For example, the positioning projection 61 is made of an elastic member such as synthetic rubber separate from the intermediate transfer belt 24. The positioning projection 61 is fixed to the inner peripheral surface 24*b* of the intermediate transfer belt 24 by bonding or the like, and is capable of running around the intermediate transfer belt 24 integrally. The positioning projection 61 is disposed close to a side edge 24*a* of the intermediate transfer belt 24.

In FIG. 3, a direction (direction toward the central side of the roller axis) approaching the secondary transfer backup roller 32 along the roller axis (center axis C) of the secondary transfer backup roller 32 is referred to as a "first direction D1". The first direction D1 corresponds to a direction toward the left side in FIG. 3. A direction (direction outside the roller axis) away from the secondary transfer backup roller 32 along the roller axis (center axis C), that is, the direction opposite to the first direction D1, is referred to as a "second direction D2". The second direction D2 corresponds to a direction toward the right side in FIG. 3.

As illustrated in FIG. 4, the first rotating body 71 is formed in a columnar shape. A reference numeral C1 is the center axis (rotating body axis) of the first rotating body 71. A direction along a center axis C1 is referred to as an axial direction. A recess 71*b* is formed at the center of one end surface 71*a* (upper surface in FIG. 4) in the axial direction of the first rotating body 71. At the center of the bottom of the recess 71*b*, an insertion hole 71*c* penetrating the first rotating body 71 in the axial direction is formed.

The first rotating body 71 is rotatably supported by a shaft member 73. The shaft member 73 includes a head portion 73*a* and a support shaft 73*b* extending from the head portion 73*a*. The support shaft 73*b* is inserted into the insertion hole 71*c* of the first rotating body 71. With this configuration, the first rotating body 71 is rotatable around the center axis C1. The head portion 73*a* is accommodated in the recess 71*b*. For example, the first rotating body 71 is made of an elastic member such as synthetic rubber.

The first rotating body 71 and the shaft member 73 are provided on the inner peripheral surface 24*b* side of the intermediate transfer belt 24. The first rotating body 71 is installed such that the end face 71*a* faces the inner peripheral face 24*b*. The end face 71*a* of the first rotating body 71 is preferably apart from the inner peripheral face 24*b*. For example, the center axis C1 of the first rotating body 71 is perpendicular to the intermediate transfer belt 24.

At least a portion of an outer peripheral surface 71*d* of the first rotating body 71 faces an inner side surface 61*a* (left surface in FIG. 4) which is the surface of the positioning projection 61 on the first direction D1 side. The outer peripheral surface 71*d* of the first rotating body 71 is preferably separated from the inner side surface 61*a*. At a point of the outer peripheral surface 71*d* closest to the inner side surface 61*a*, a direction of a tangent line perpendicular to the center axis C1 is parallel to an extending direction of the positioning projection 61.

When the intermediate transfer belt 24 and the positioning projection 61 move in the first direction D1, the inner side surface 61*a* of the positioning projection 61 abuts on the outer peripheral surface 71*d* of the first rotating body 71. For that reason, the movement of the intermediate transfer belt 24 in the first direction D1 is regulated. With this configuration, deviation of the intermediate transfer belt 24 can be suppressed. Therefore, the reliability of the positioning of the intermediate transfer belt 24 can be improved.

When the positioning projection 61 abuts on the outer peripheral surface 71*d* of the first rotating body 71, the first rotating body 71 rotates around the center axis C1 as the intermediate transfer belt 24 and the positioning projection 61 run. For that reason, the frictional resistance between the positioning projection 61 and the first rotating body 71 can be suppressed.

The second rotating body 72 is formed in a columnar shape. A reference numeral C2 is the center axis (rotating body axis) of the second rotating body 72. A direction along a center axis C2 is referred to as the axial direction. At the central part of the second rotating body 72, an insertion hole 72*c* penetrating the second rotating body 72 in the axial direction is formed.

The second rotating body 72 is rotatably supported by a shaft member 74. The shaft member 74 includes a head portion 74*a* and a support shaft 74*b* extending from the head portion 74*a*. The support shaft 74*b* is inserted into the insertion hole 72*c* of the second rotating body 72. With this configuration, the second rotating body 72 can rotate around the center axis C2. The center axis C2 of the second rotating body 72 is parallel to the center axis C (roller axis) (see FIG. 3). For example, the second rotating body 72 is made of an elastic member such as synthetic rubber.

The second rotating body 72 and the shaft member 74 are provided on the outer peripheral surface 24*c* side of the intermediate transfer belt 24. The second rotating body 72 is installed such that at least a portion of the outer peripheral surface 72*d* faces the outer peripheral surface 24*c* of the intermediate transfer belt 24. The outer peripheral surface 72*d* of the second rotating body 72 is preferably separated from the outer peripheral surface 24*c*. At a point of the outer peripheral surface 72*d* closest to the outer peripheral surface 24*c*, a direction of a tangent line perpendicular to the center axis C2 is parallel to a running direction of the intermediate transfer belt 24.

A distance a between the outer peripheral surface 72*d* of the second rotating body 72 and the outer peripheral surface 24*c* of the intermediate transfer belt 24 is preferably smaller than a thickness A of the positioning projection 61. With this configuration, it is possible to regulate that the positioning projection 61 comes off the position where the positioning projection 61 can be made to abut on the first rotating body 71.

At least a portion of the outer peripheral surface 72*d* of the second rotating body 72 faces an outer peripheral surface 61*c* (upper surface in FIG. 4) of the positioning projection 61 via the intermediate transfer belt 24.

When the intermediate transfer belt 24 and the positioning projection 61 move in a direction (upward in FIG. 4) away from the center axis C (roller axis) (see FIG. 3), the outer peripheral surface 24*c* of the intermediate transfer belt 24 abuts on the outer peripheral surface 72*d* of the second rotating body 72. For that reason, the outward movement (upward movement in FIG. 4) of the intermediate transfer belt 24 is regulated. With this configuration, it is possible to regulate that the positioning projection 61 comes off the position where the positioning projection 61 can be made to abut on the first rotating body 71. Therefore, the reliability of the positioning of the intermediate transfer belt 24 can be improved.

When the intermediate transfer belt 24 abuts on the outer peripheral surface 72*d* of the second rotating body 72, the second rotating body 72 rotates around the center axis C2 as the intermediate transfer belt 24 runs. For that reason, the frictional resistance between the intermediate transfer belt 24 and the second rotating body 72 can be suppressed.

Next, a belt positioning structure 30B which is a second example of the belt positioning structure 30 will be described with reference to FIG. 5. The same components as those of the belt positioning structure 30A illustrated in FIG. 4 are denoted by the same reference numerals, and description thereof is omitted.

Figure 5:
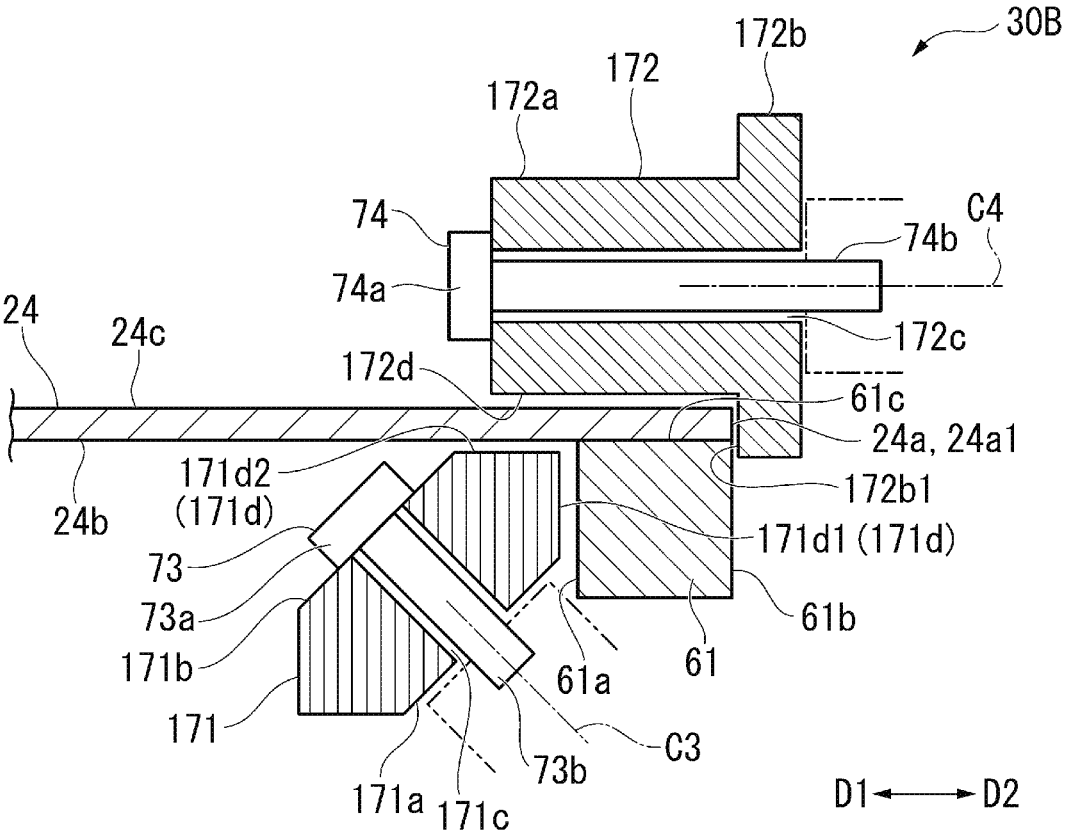
FIG. 5 is a cross-sectional view of a second example of the belt positioning structure.

As illustrated in FIG. 5, the belt positioning structure 30B is different from the belt positioning structure 30A illustrated in FIG. 4 in that a first rotating body 171 and a second rotating body 172 are used instead of the first rotating body 71 and the second rotating body 72.

An outer peripheral surface 171*d* of the first rotating body 171 includes a first region 171*d*1 and a second region 171*d*2. The first region 171*d*1 is a region of the outer peripheral surface 171*d* extending from one end 171*a* (first end 171*a*) in the axial direction of the first rotating body 171 to the center in the axial direction. The first region 171*d*1 is tapered such that the outer diameter gradually increases from the first end 171*a* toward the center in the axial direction. The second region 171*d*2 is a region of the outer peripheral surface 171*d* extending from the other end 171*b* (second end 171*b*) in the axial direction of the first rotating body 171 to the center in the axial direction. The second region 171*d*2 is tapered such that the outer diameter gradually increases from the second end 171*b* toward the center in the axial direction.

An insertion hole 171*c* penetrating in the axial direction is formed in the first rotating body 171.

The first rotating body 171 is rotatably supported by the shaft member 73. The support shaft 73*b* of the shaft member 73 is inserted into the insertion hole 171*c* of the first rotating body 171. With this configuration, the first rotating body 171 is rotatable around a center axis C3.

The first rotating body 171 and the shaft member 73 are provided on the inner peripheral surface 24*b* side of the intermediate transfer belt 24.

At least a portion of the first region 171*d*1 of the outer peripheral surface 171*d* of the first rotating body 171 faces the inner side surface 61*a* (left side surface in FIG. 5) which is the surface of the positioning projection 61 on the first direction D1 side. The first region 171*d*1 is preferably separated from the inner side surface 61*a*.

At least a portion of the second region 171*d*2 of the outer peripheral surface 171*d* of the first rotating body 171 faces the inner peripheral surface 24*b*. The second region 171*d*2 is preferably separated from the inner peripheral surface 24*b*. The center axis C3 of the first rotating body 171 is inclined in a direction away from the intermediate transfer belt 24 as the center axis C3 goes in the second direction D2.

When the intermediate transfer belt 24 and the positioning projection 61 move in the first direction D1, the inner side surface 61*a* of the positioning projection 61 abuts on the first region 171*d*1 of the outer peripheral surface 171*d* of the first rotating body 171. For that reason, the movement of the intermediate transfer belt 24 in the first direction D1 is regulated. With this configuration, the deviation of the intermediate transfer belt 24 can be suppressed. Therefore, the reliability of the positioning of the intermediate transfer belt 24 can be improved.

When the positioning projection 61 abuts on the first region 171*d*1 of the outer peripheral surface 171*d* of the first rotating body 171, the first rotating body 171 rotates around the center axis C3 as the intermediate transfer belt 24 and the positioning projection 61 run. For that reason, the frictional resistance between the positioning projection 61 and the first rotating body 171 can be suppressed.

When the intermediate transfer belt 24 moves in the direction (downward in FIG. 5) approaching the center axis C (see FIG. 3), the inner peripheral surface 24*b* abuts on the second region 171*d*2 of the outer peripheral surface 171*d* of the first rotating body 171. For that reason, the movement of the intermediate transfer belt 24 in the direction approaching the center axis C (see FIG. 3) is regulated.

When the intermediate transfer belt 24 abuts on the second region 171*d*2 of the outer peripheral surface 171*d* of the first rotating body 171, the first rotating body 171 rotates around the center axis C3 as the intermediate transfer belt 24 and the positioning projection 61 run. For that reason, the frictional resistance between the intermediate transfer belt 24 and the first rotating body 171 can be suppressed.

The second rotating body 172 includes a columnar main portion 172*a*, and a flange part 172*b* provided at one end (end in the second direction D2) in the axial direction of the columnar main portion 172*a*. A reference symbol C4 is the center axis (rotating body axis) of the second rotating body 172. At the center of the second rotating body 172, an insertion hole 172*c* penetrating the second rotating body 172 in the axial direction is formed.

The second rotating body 172 is rotatably supported by the shaft member 74. The support shaft 74*b* of the shaft member 74 is inserted into the insertion hole 172*c* of the second rotating body 172. With this configuration, the second rotating body 172 is rotatable around a center axis C4. The center axis C4 of the second rotating body 172 is parallel to the center axis C (roller axis) (see FIG. 3).

The second rotating body 172 and the shaft member 74 are provided on the outer peripheral surface 24*c* side of the intermediate transfer belt 24. The second rotating body 172 is installed such that at least a portion of an outer peripheral surface 172*d* of the columnar main portion 172*a* faces the outer peripheral surface 24*c* of the intermediate transfer belt 24. The outer peripheral surface 172*d* of the second rotating body 172 is preferably separated from the outer peripheral surface 24*c*.

At least a portion of the outer peripheral surface 172*d* of the second rotating body 172 faces the outer peripheral surface 61*c* (upper surface in FIG. 5) of the positioning projection 61 via the intermediate transfer belt 24.

The flange part 172*b* is formed to protrude radially outward of the second rotating body 172 with respect to the columnar main portion 172*a*. At least a portion of an inner side surface 172*b*1 of the flange part 172*b* on the first direction D1 side faces an end surface 24*a*1 of the side edge 24*a* of the intermediate transfer belt 24 on the second direction D2 side. The inner side surface 172*b*1 is preferably separated from the end surface 24*a*1.

A portion of the inner side surface 172*b*1 may face an outer side surface 61*b* (right side surface in FIG. 5) which is the surface of the positioning projection 61 on the second direction D2 side. The inner side surface 172*b*1 is preferably separated from the outer side surface 61*b*.

When the intermediate transfer belt 24 and the positioning projection 61 move in a direction (upward in FIG. 5) away from the center axis C (roller axis) (see FIG. 3), the outer peripheral surface 24*c* of the intermediate transfer belt 24 abuts on the outer peripheral surface 172*d* of the second rotating body 172. For that reason, the outward movement (upward movement in FIG. 5) of the intermediate transfer belt 24 is regulated. With this configuration, it is possible to regulate that the positioning projection 61 comes off the position where the positioning projection 61 can be made to abut on the first rotating body 171. Therefore, the reliability of the positioning of the intermediate transfer belt 24 can be improved.

When the intermediate transfer belt 24 abuts on the outer peripheral surface 172*d* of the second rotating body 172, the second rotating body 172 rotates around the center axis C4 as the intermediate transfer belt 24 runs. For that reason, the frictional resistance between the intermediate transfer belt 24 and the second rotating body 172 can be suppressed.

The flange part 172*b* can regulate the intermediate transfer belt 24 from moving to the second direction D2 side.

Next, a belt positioning structure 30C which is a third example of the belt positioning structure 30 will be described with reference to FIG. 6. The same components as those of the belt positioning structures 30A and 30B illustrated in FIGS. 4 and 5 are denoted by the same reference numerals, and description thereof is omitted.

Figure 6:
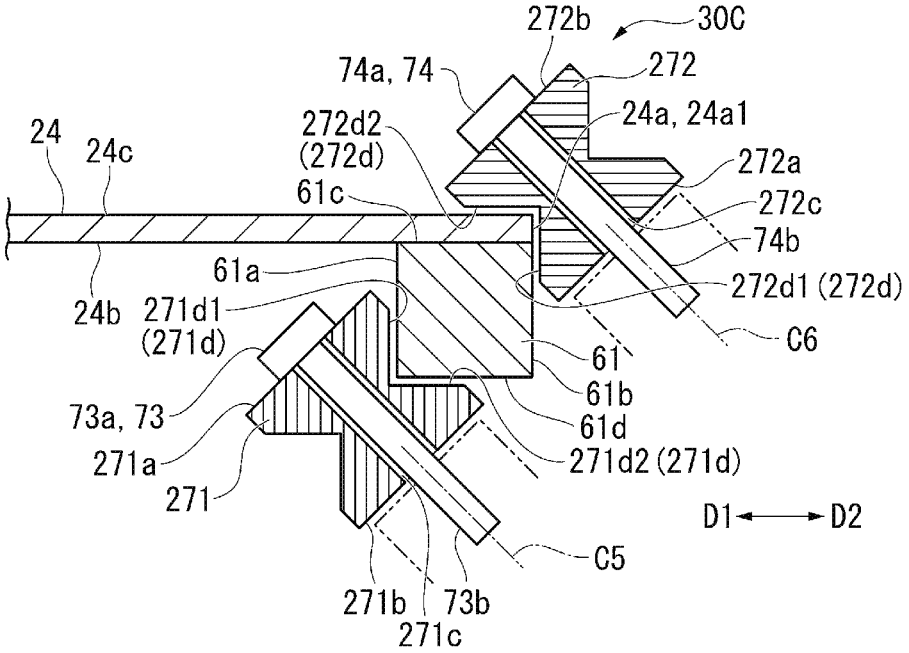
FIG. 6 is a cross-sectional view of a third example of the belt positioning structure.

As illustrated in FIG. 6, the belt positioning structure 30C is different from the belt positioning structure 30A illustrated in FIG. 4 in that a first rotating body 271 and a second rotating body 272 are used instead of the first rotating body 71 and the second rotating body 72.

An outer peripheral surface 271*d* of the first rotating body 271 includes a first region 271*d*1 and a second region 271*d*2. The first region 271*d*1 is a tapered region in which the outer diameter gradually decreases from a position close to a first end 271*a* toward the center in the axial direction. The second region 271*d*2 is a tapered region in which the outer diameter gradually decreases from a position close to a second end 271*b* toward the center in the axial direction.

An insertion hole 271*c* penetrating in the axial direction is formed in the first rotating body 271.

The first rotating body 271 is rotatably supported by the shaft member 73. The support shaft 73*b* of the shaft member 73 is inserted into the insertion hole 271*c* of the first rotating body 271. With this configuration, the first rotating body 271 is rotatable around a center axis C5.

The first rotating body 271 and the shaft member 73 are provided on the inner peripheral surface 24*b* side of the intermediate transfer belt 24.

At least a portion of the first region 271*d*1 of the outer peripheral surface 271*d* of the first rotating body 271 faces the inner side surface 61*a* (left side surface in FIG. 6) which is the surface of the positioning projection 61 on the first direction D1 side. The first region 271*d*1 is preferably separated from the inner side surface 61*a*.

At least a portion of the second region 271*d*2 of the outer peripheral surface 271*d* of the first rotating body 271 faces the inner peripheral surface 61*d* (lower surface in FIG. 6) of the positioning projection 61. The second region 271*d*2 is preferably separated from the inner peripheral surface 61*d*. The center axis C5 of the first rotating body 271 is inclined in a direction away from the intermediate transfer belt 24 as the center axis C5 goes in the second direction D2.

When the intermediate transfer belt 24 and the positioning projection 61 move in the first direction D1, the inner side surface 61*a* of the positioning projection 61 abuts on the first region 271*d*1 of the outer peripheral surface 271*d* of the first rotating body 271. For that reason, the movement of the intermediate transfer belt 24 in the first direction D1 is regulated. With this configuration, the deviation of the intermediate transfer belt 24 can be suppressed. Therefore, the reliability of the positioning of the intermediate transfer belt 24 can be improved.

When the positioning projection 61 abuts on the first region 271*d*1 of the outer peripheral surface 271*d* of the first rotating body 271, the first rotating body 271 rotates around the center axis C5 as the intermediate transfer belt 24 and the positioning projection 61 run. For that reason, the frictional resistance between the positioning projection 61 and the first rotating body 271 can be suppressed.

When the intermediate transfer belt 24 and the positioning projection 61 move in a direction approaching the center axis C (see FIG. 3), the inner peripheral surface 61*d* of the positioning projection 61 abuts on the second region 271*d*2 of the outer peripheral surface 271*d* of the first rotating body 271. For that reason, the movement of the intermediate transfer belt 24 in the direction approaching the center axis C (see FIG. 3) is regulated.

When the positioning projection 61 abuts on the second region 271*d*2 of the outer peripheral surface 271*d* of the first rotating body 271, the first rotating body 271 rotates around the center axis C5 as the intermediate transfer belt 24 and the positioning projection 61 run. For that reason, the frictional resistance between the positioning projection 61 and the first rotating body 271 can be suppressed.

An outer peripheral surface 272*d* of the second rotating body 272 includes a third region 272*d*1 and a fourth region 272*d*2. The third region 272*d*1 is a tapered region in which the outer diameter gradually decreases from a position close to a first end 272*a* toward the center in the axial direction. The fourth region 272*d*2 is a tapered region in which the outer diameter gradually decreases from a position close to a second end 272*b* toward the center in the axial direction.

An insertion hole 272*c* penetrating in the axial direction is formed in the second rotating body 272.

The second rotating body 272 is rotatably supported by the shaft member 74. The support shaft 74*b* of the shaft member 74 is inserted into the insertion hole 272*c* of the second rotating body 272. With this configuration, the second rotating body 272 is rotatable around a center axis C6.

At least a portion of the third region 272*d*1 of the outer peripheral surface 272*d* of the second rotating body 272 faces the end surface 24*a*1 of the side edge 24*a* of the intermediate transfer belt 24 on the second direction D2 side. The third region 272*d*1 is preferably separated from the end face 24*a*1.

A portion of the third region 272*d*1 may face the outer side surface 61*b* (right side surface in FIG. 6) which is the surface of the positioning projection 61 on the second direction D2 side. The third region 272*d*1 is preferably separated from the outer side surface 61*b*.

At least a portion of the fourth region 272*d*2 of the outer peripheral surface 272*d* of the second rotating body 272 faces the outer peripheral surface 24*c* of the intermediate transfer belt 24. The fourth region 272*d*2 of the second rotating body 272 is preferably separated from the outer peripheral surface 24*c*.

At least a portion of the fourth region 272*d*2 of the second rotating body 272 faces the outer peripheral surface 61*c* (upper surface in FIG. 6) of the positioning projection 61 via the intermediate transfer belt 24.

The center axis C6 of the second rotating body 272 is parallel to the center axis C5 of the first rotating body 271.

When the intermediate transfer belt 24 and the positioning projection 61 move in a direction (upward in FIG. 6) away from the center axis C (roller axis) (see FIG. 3), the outer peripheral surface 24*c* of the intermediate transfer belt 24 abuts on the fourth region 272*d*2 of the outer peripheral surface 272*d* of the second rotating body 272. For that reason, the outward movement (upward movement in FIG. 6) of the intermediate transfer belt 24 is regulated. With this configuration, it is possible to regulate that the positioning projection 61 comes off the position where the positioning projection 61 can be made to abut on the first rotating body 271. Therefore, the reliability of the positioning of the intermediate transfer belt 24 can be improved.

When the intermediate transfer belt 24 abuts on the outer peripheral surface 272*d* of the second rotating body 272, the second rotating body 272 rotates around the center axis C6 as the intermediate transfer belt 24 runs. For that reason, the frictional resistance between the intermediate transfer belt 24 and the second rotating body 272 can be suppressed.

The third region 272*d*1 can regulate the intermediate transfer belt 24 from moving to the second direction D2 side.

Next, a belt positioning structure 30*d* which is a fourth example of the belt positioning structure 30 will be described with reference to FIG. 7. The same components as those of the belt positioning structures 30A, 30B, and 30C illustrated in FIGS. 4 to 6 are denoted by the same reference numerals, and description thereof is omitted.

Figure 7:
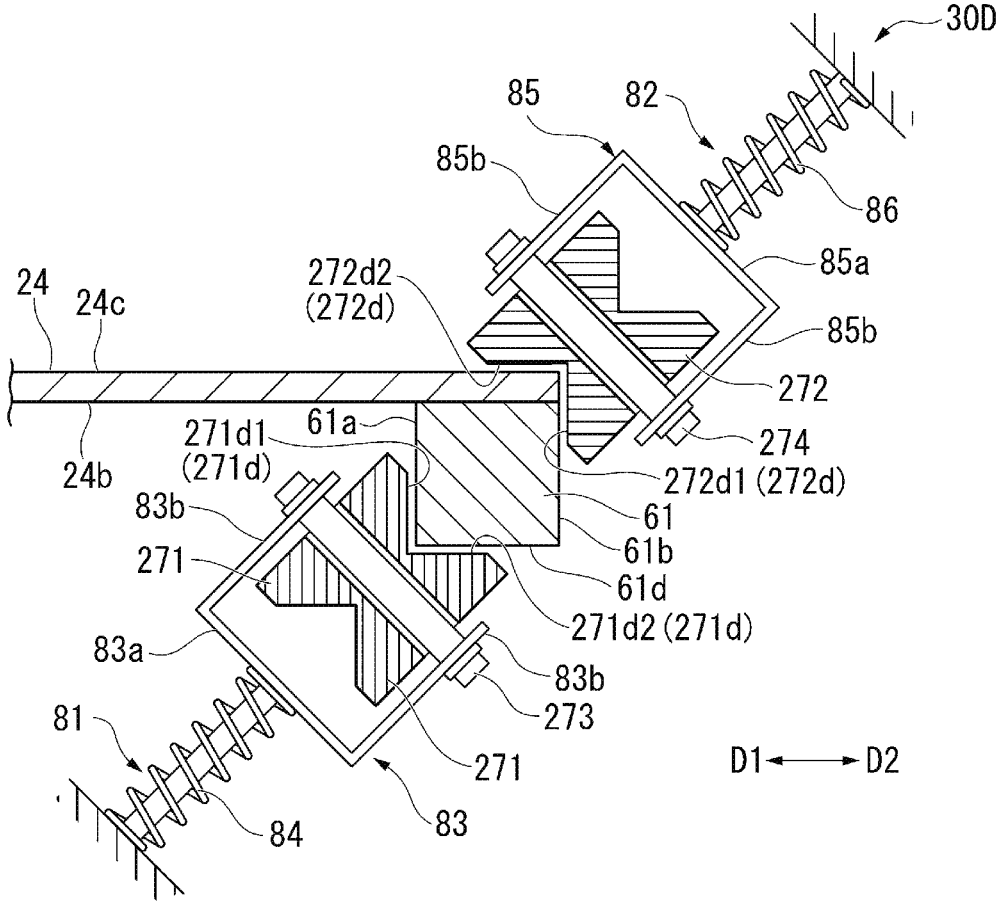
FIG. 7 is a cross-sectional view of a fourth example of the belt positioning structure.

As illustrated in FIG. 7, the belt positioning structure 30D is different from the belt positioning structure 30C illustrated in FIG. 6 in that a first urging mechanism 81 and a second urging mechanism 82 are provided.

The first urging mechanism 81 includes a first shaft holding portion 83 and a first urging body 84. The first shaft holding portion 83 includes a substrate 83*a* and a pair of side plates 83*b*, 83*b*. The side plate portions 83*b*, 83*b* hold a shaft member 273 that rotatably supports the first rotating body 271. The first urging body 84 is connected to the substrate 83*a*. The first urging body 84 is, for example, an elastic member such as a coil spring. The first urging body 84 urges the first rotating body 271 in a direction approaching the positioning projection 61 via the first shaft holding portion 83.

The second urging mechanism 82 includes a second shaft holding portion 85 and a second urging body 86. The second shaft holding portion 85 includes a substrate 85*a* and a pair of side plates 85*b*, 85*b*. The side plates 85*b*, 85*b* hold a shaft member 274 that rotatably supports the second rotating body 272. The second urging body 86 is connected to the substrate 85*a*. The second urging body 86 is, for example, an elastic member such as a coil spring. The second urging body 86 urges the second rotating body 272 in a direction approaching the positioning projection 61 via the second shaft holding portion 85.

In the belt positioning structure 30D, the first rotating body 271 and the second rotating body 272 are urged toward the positioning projection 61 by the first urging mechanism 81 and the second urging mechanism 82, and thus the positioning projection 61 can be stably positioned. Therefore, the reliability of the positioning of the intermediate transfer belt 24 can be improved.

In the belt positioning structure 30D, although the first rotating body 271 is provided with the first urging mechanism 81 and the second rotating body 272 is provided with the second urging mechanism 82, the urging mechanism may be provided on only one of the first rotating body and the second rotating body. That is, the urging mechanism may be provided on at least one of the first rotating body and the second rotating body.

Next, examples of installation positions of the first rotating body and the second rotating body will be described with reference to FIG. 8.

Figure 8:
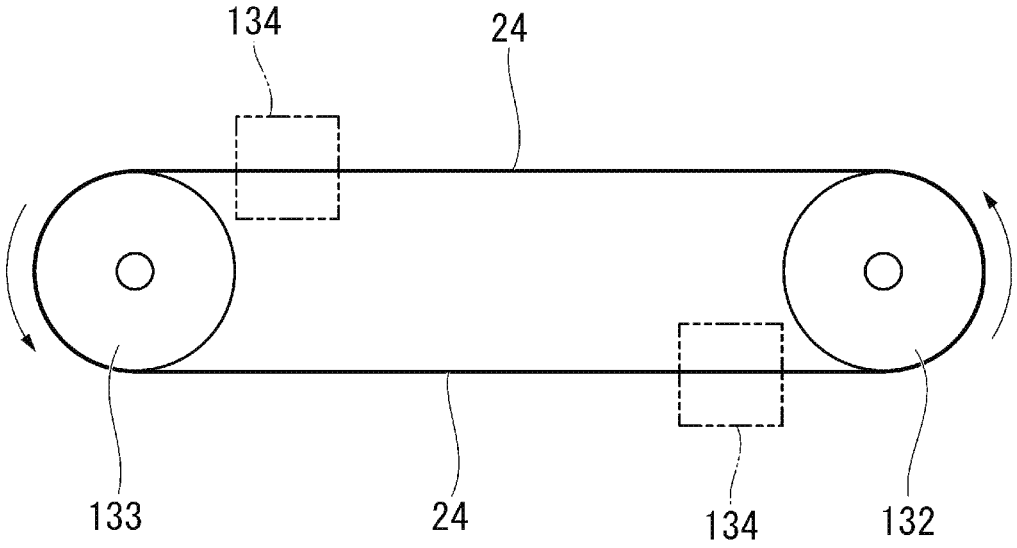
FIG. 8 is a schematic view illustrating an example of installation positions of a first rotating body and a second rotating body in the embodiment.

FIG. 8 illustrates a belt positioning structure including a driving roller 132 (belt roller), a driven roller 133 (belt roller), and the intermediate transfer belt 24. Units 134 including the first rotating body and the second rotating body are provided on the upstream side of the driving roller 132 in a belt running direction and on the upstream side of the driven roller 133 in the belt running direction, respectively.

Since the units 134 are respectively provided on the upstream sides of the rollers 132 and 133, the positioning projection 61 can be stably positioned. Therefore, the reliability of the positioning of the intermediate transfer belt 24 can be improved.

Figure 9:
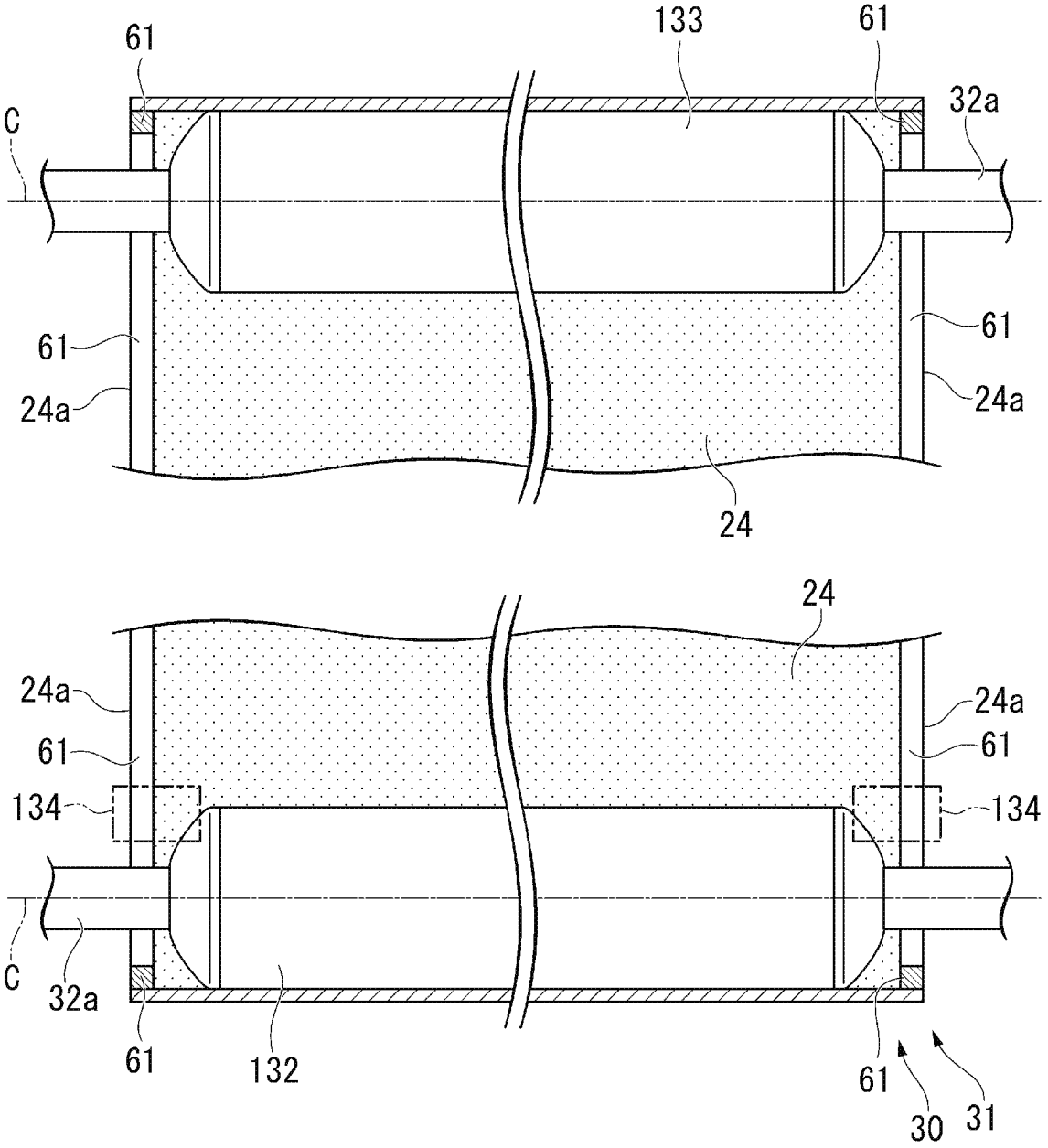
FIG. 9 is a plan view illustrating the example of the installation positions of the first rotating body and the second rotating body.

As illustrated in FIG. 9, the units 134 including the first rotating body and the second rotating body can be provided at both ends in a width direction of the intermediate transfer belt 24, respectively. With this configuration, the intermediate transfer belt 24 is positioned at both ends in the width direction (roller axis direction). As a result, the deviation of the intermediate transfer belt 24 in both directions in the roller axis direction is suppressed. Therefore, the reliability of the positioning of the intermediate transfer belt 24 can be improved.

Although the first rotating body and the second rotating body are included in the belt positioning structure 30, the belt positioning structure according to the embodiment may be configured without the second rotating body. In this case, instead of the second rotating body, a non-rotating type regulating member that regulates movement of the belt in the direction away from the roller axis may be provided.

Although the positioning projection 61 is formed continuously in the length direction of the intermediate transfer belt 24 in the belt positioning structure 30, the configuration of the positioning projection is not particularly limited. For example, the positioning projections may be formed discontinuously in the length direction of the intermediate transfer belt. Specifically, the positioning projection may be a projection formed intermittently along the length direction of the intermediate transfer belt.

The image forming apparatus may be a monochrome image forming apparatus. The number of image forming parts is not limited. The image forming apparatus may include a plurality of printer units.

The belt positioning structure according to the present embodiment may be applied to a transfer belt used in a direct transfer type printer unit.

According to at least one embodiment described above, by providing the first rotating body that regulates the projection from moving in the first direction approaching the belt roller along the roller axis, the reliability of belt positioning can be improved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A belt positioning structure, comprising:

a belt roller configured to rotate about a roller axis;

an endless belt configured to be wound around the belt roller;

a projection provided so as to protrude from an inner peripheral surface of the endless belt;

a first rotating body configured to regulate the projection from moving in a first direction approaching the belt roller along the roller axis, wherein the first rotating body is rotatable around an axis, and at least a portion of an outer peripheral surface of the first rotating body faces a side surface of the projection on the first direction side; and a second rotating body configured to regulate the endless belt from moving in a direction away from the roller axis, wherein the second rotating body is rotatable around an axis, and at least a portion of an outer peripheral surface of the second rotating body faces an outer peripheral surface of the endless belt, and wherein a flange part protruding radially outward of the second rotating body is provided on the outer peripheral surface of the second rotating body, and at least a portion of a side surface of the flange part on the first direction side faces an end surface of the endless belt on a second direction side opposite to the first direction.

2. The structure according to claim 1, wherein the outer peripheral surface of the first rotating body includes a first region that regulates the projection from moving in the first direction and a second region that regulates the endless belt from moving in a direction approaching the roller axis, at least a portion of the first region faces the side surface of the projection on the first direction side, and at least a portion of the second region faces the inner peripheral surface of the endless belt.

3. The structure according to claim 1, wherein the outer peripheral surface of the first rotating body includes a first region that regulates the projection from moving in the first direction and a second region that regulates the projection from moving in a direction approaching the roller axis, at least a portion of the first region faces the side surface of the projection on the first direction side, and at least a portion of the second region faces an inner peripheral surface of the projection.

4. A belt positioning structure, comprising:

a belt roller configured to rotate about a roller axis;

an endless belt configured to be wound around the belt roller;

a projection provided so as to protrude from an inner peripheral surface of the endless belt;

a first rotating body configured to regulate the projection from moving in a first direction approaching the belt roller along the roller axis, wherein the first rotating body is rotatable around an axis, and at least a portion of an outer peripheral surface of the first rotating body faces a side surface of the projection on the first direction side; and a second rotating body configured to regulate the endless belt from moving in a direction away from the roller axis, wherein the second rotating body is rotatable around an axis, and at least a portion of an outer peripheral surface of the second rotating body faces an outer peripheral surface of the endless belt, wherein the outer peripheral surface of the second rotating body includes a third region that regulates the endless belt from moving in a second direction opposite to the first direction and a fourth region that regulates the endless belt from moving in a direction away from the roller axis, at least a portion of the third region faces an end surface of the endless belt on the second direction side, and at least a portion of the fourth region faces the outer peripheral surface of the endless belt.

5. A belt positioning structure, comprising:

a belt roller configured to rotate about a roller axis;

an endless belt configured to be wound around the belt roller;

a projection provided so as to protrude from an inner peripheral surface of the endless belt;

a first rotating body configured to regulate the projection from moving in a first direction approaching the belt roller along the roller axis, wherein the first rotating body is rotatable around an axis, and at least a portion of an outer peripheral surface of the first rotating body faces a side surface of the projection on the first direction side;

a second rotating body configured to regulate the endless belt from moving in a direction away from the roller axis, wherein the second rotating body is rotatable around an axis, and at least a portion of an outer peripheral surface of the second rotating body faces an outer peripheral surface of the endless belt; and an urging mechanism configured to urge at least one of the first rotating body and the second rotating body in a direction approaching the projection.

6. The structure according to claim 1, wherein the first rotating body and the second rotating body are provided on an upstream side in a running direction of the endless belt.

7. The structure according to claim 4, wherein the outer peripheral surface of the first rotating body includes a first region that regulates the projection from moving in the first direction and a second region that regulates the endless belt from moving in a direction approaching the roller axis, at least a portion of the first region faces the side surface of the projection on the first direction side, and at least a portion of the second region faces the inner peripheral surface of the endless belt.

8. The structure according to claim 4, wherein the outer peripheral surface of the first rotating body includes a first region that regulates the projection from moving in the first direction and a second region that regulates the projection from moving in a direction approaching the roller axis, at least a portion of the first region faces the side surface of the projection on the first direction side, and at least a portion of the second region faces an inner peripheral surface of the projection.

9. The structure according to claim 4, wherein the first rotating body and the second rotating body are provided on an upstream side in a running direction of the endless belt.

10. The structure according to claim 5, wherein the outer peripheral surface of the first rotating body includes a first region that regulates the projection from moving in the first direction and a second region that regulates the endless belt from moving in a direction approaching the roller axis, at least a portion of the first region faces the side surface of the projection on the first direction side, and at least a portion of the second region faces the inner peripheral surface of the endless belt.

11. The structure according to claim 5, wherein the outer peripheral surface of the first rotating body includes a first region that regulates the projection from moving in the first direction and a second region that regulates the projection from moving in a direction approaching the roller axis, at least a portion of the first region faces the side surface of the projection on the first direction side, and at least a portion of the second region faces an inner peripheral surface of the projection.

12. The structure according to claim 5, wherein the first rotating body and the second rotating body are provided on an upstream side in a running direction of the endless belt.

* * * * *